US008684220B2

(12) United States Patent
Harvey

(10) Patent No.: US 8,684,220 B2
(45) Date of Patent: Apr. 1, 2014

(54) STORAGE TANK WITH FLEXIBLE SHEAR PAD

(75) Inventor: Kenneth Ryan Harvey, Newberry, FL (US)

(73) Assignee: The Crom Corporation, Gainesville, FL (US)

( * ) Notice: Subject to any disclaimer, the term of this patent is extended or adjusted under 35 U.S.C. 154(b) by 383 days.

(21) Appl. No.: 12/468,617

(22) Filed: May 19, 2009

(65) Prior Publication Data

US 2010/0294778 A1 Nov. 25, 2010

(51) Int. Cl.
*B65D 90/08* (2006.01)
*E04H 7/20* (2006.01)

(52) U.S. Cl.
USPC ..... 220/565; 52/223.2; 52/223.3

(58) Field of Classification Search
CPC ..... B65D 90/02; B65D 90/08; B65D 88/00; B65D 88/02; E04H 7/20; E04H 7/00
USPC ..... 220/565, 567; 52/167.1–167.9, 247, 52/1.6, 250, 223.3, 294, 148, 167.7
See application file for complete search history.

(56) References Cited

U.S. PATENT DOCUMENTS 1,301,155 A * 4/1919 Mueser ..... 52/247
2,289,913 A * 7/1942 Joor, Jr. ..... 220/565
2,370,780 A 3/1945 Crom
3,233,376 A 2/1966 Naillon et al.
3,538,661 A 11/1970 Nelson
3,822,520 A 7/1974 Crom, Jr.
3,927,497 A * 12/1975 Yoshinaga et al. ..... 52/247
4,041,722 A 8/1977 Terlesky et al.
4,068,777 A * 1/1978 Humphrey et al. ..... 220/565
4,069,642 A 1/1978 Hendriks
4,074,485 A 2/1978 Hendriks
RE29,777 E * 9/1978 Crowley ..... 52/223.3
4,271,647 A 6/1981 Balck, Jr.
4,344,264 A 8/1982 Smith
4,366,654 A 1/1983 Bomhard
4,776,145 A 10/1988 Dykmans
5,094,044 A 3/1992 Dykmans
5,150,551 A 9/1992 Crom et al.
5,675,941 A 10/1997 Dykmans

* cited by examiner

*Primary Examiner* — Andrew Perreault
(74) *Attorney, Agent, or Firm* — Stinson Leonard Street LLP

(57) ABSTRACT

A concrete storage tank structure comprises a tank including a floor slab having a periphery and a wall having inner and outer faces extending upwardly from the floor slab at a position adjacent the periphery of the latter. The tank structure further includes a shear pad extending outwardly away from the tank from a position adjacent a lower portion of the outer face of the wall. The shear pad and the tank are positioned relative to one another in such a way that a space is provided therebetween and a number of elongated flexible connecting elements are arranged so as to extend through the space in interconnecting relationship relative to the shear pad and the tank. A strip of resilient neoprene elastomeric material is disposed in the space. The shear pad is thus flexibly attached to the tank in such a way that the forces imposed on the wall of the tank by the shear pad during movement of the tank during use are minimized.

27 Claims, 3 Drawing Sheets

STORAGE TANK WITH FLEXIBLE SHEAR PAD

CROSS REFERENCE TO RELATED APPLICATION

None.

BACKGROUND OF THE INVENTION

1. Field of the Invention

The present invention is directed generally to tanks used for storing liquids such as water and, more particularly, to large storage tanks, usually concrete tanks, having some sort of structure for eliminating or at least minimizing lateral or rotational movement of the tank when the same is subjected to lateral forces, such as may occur during backfilling and/or earthquakes and the like.

2. The Prior Art Background

As a brief background, storage tanks, including conventional prestressed composite concrete tanks, may generally comprise a floor slab and an upright annular wall that sits on the floor slab. The floor slab desirably lies on a level ground surface (subgrade). Conventionally, the wall, with respect to the floor slab, may be either monolithic or free sliding. Generally speaking, monolithic tanks may be more cost effective than tanks where the tank wall and the floor slab are free sliding. The latter is particularly true in connection with smaller tanks.

As the name implies, where a monolithic design is used, the floor slab and the walls of the tank are constructed with reinforcing steel passing through the joint and developed into both the floor slab and the wall. This reinforcing steel effectively ties the two pieces of the tank, the floor slab and the wall, together so that they act as one. Moments are transferred into the wall due to loads placed on the floor slab and vice-versa. When designing the tank, these moments may be calculated using an engineering theory known as moment distribution. Using moment distribution a certain percentage of the moment in the wall is distributed to the floor slab. This distribution is based on the relative stiffnesses of the floor and wall segments.

Necessarily storage tanks may often be subjected to significant horizontal lateral forces. Such forces may occur, for example, during the backfilling of the tank. To be more specific, in many instances the terrain where a tank is to be constructed is not level but is instead sloped, e.g., on the side of a hill. Prior to construction of the tank, earth may be excavated from the hillside to provide a level base for the tank. Once the tank is completed, earth is replaced, particularly along the uphill side of the wall structure of the tank, to restore natural grades. Backfilling on only a portion of the wall structure, or unequal backfilling on opposite sides of the tank, however, may create lateral forces which tend to displace the tank off the excavated ground surface in the downhill direction, or at least tend to cause the structure to slide laterally across the level ground surface. Another example of the occurrence of such forces is during an earthquake or earth tremor where unequal lateral forces tending to displace the tank may be imposed on the walls of the tank from any direction.

Expanding on the foregoing, when a tank is backfilled differentially, that is to say, the backfill is higher on one side of the tank than the other, sliding can be induced on the tank structure by the load resulting from the backfill if the friction between the floor slab and the subgrade is overcome. In the past, when differential backfill presented a potential problem, it was conventional to use a tank design where a slab projecting outwardly from the tank near its base on the uphill side of the tank was employed. This provided additional surface area and thus additional frictional forces to resist the lateral forces resulting from differential backfill loading. Such a projecting slab was known as a shear pad.

The prior use of such shear pads did not come without additional cost, particularly where a monolithic design was to be used for the tanks. That is to say, such a projecting slab loaded with soil backfill on the outer side of the wall, particularly where the tank had a monolithic wall/floor joint, served to stiffen the joint resulting in a greater moment being distributed to the tank wall. This necessitated a thicker wall with more reinforcing steel and potentially resulted in an uncompetitive design. The most economical way then to build a differentially backfilled tank where a shear pad was desired was to use a joint design where the floor and the wall were not monolithic. The shear pad became a simple extension of the floor radially outwardly beyond the wall. Again the shortcoming was a tank that was more expensive.

SUMMARY OF THE INVENTION

The prior art problems discussed above are addressed, if not minimized, by the invention described and claimed herein. That is to say, the invention described and claimed in the present specification provides an economical storage tank having an efficient shear pad that resists the forces imposed when the tank is backfilled differentially. In accordance with the concepts and principles of the invention, the shear pad is flexibly attached to the tank in such a way that any forces imposed on the wall of the tank are minimized. In this regard the shear pad is attached to the tank wall in a "flexible" manner such that when the shear pad is loaded there will be no substantial transfer of moments from the shear pad to the wall sufficient to alter the calculated moments required for the tank wall assuming the tank were to be constructed for use in an application where differential backfill is not required.

In accordance with the concepts and principles of the invention, a storage tank structure is provided that comprises a tank including a floor slab having a periphery and a wall having inner and outer faces that extends upwardly from the floor slab at a position adjacent the periphery. The tank structure also includes a shear pad that extends outwardly away from the tank from a position adjacent a lower portion of the outer face of the wall and flexible structure extending between the tank and the shear pad permitting the latter to move relative to the tank during lateral and/or vertical shifting of the tank. Desirably, the wall of the tank may be cylindrical. In addition to the foregoing, it is preferred that the tank and the shear pad may each be constructed of concrete and that the flexible connecting element may have one end embedded in the shear pad and an opposite end embedded in the tank.

Preferably the shear pad and the tank are positioned relative to one another in such a way that a space is provided therebetween. Moreover it is preferred that the flexible structure includes a plurality of elongated flexible connecting elements extending through the space in interconnecting relationship relative to the shear pad and the tank. Desirably the wall and the floor slab are monolithic and the shear pad and said floor slab are generally coplanar.

It is also preferred, in accordance with the invention, that a resilient elastomeric material may be disposed in the space and that the flexible connecting elements are located so as to extend through the elastomeric material. Even more preferably, the flexible connecting elements may comprise steel cables and may be provided with a corrosion resistant coating.

In accordance with another aspect of the invention, the same provides a method for construction of a storage tank structure with that is resistant to sliding. In further accordance with this aspect of the invention, the method may comprise erecting a tank including a floor slab having a periphery and a wall having inner and outer faces that extends upwardly from the floor slab at a position adjacent said periphery. In further accordance with this aspect of the invention, the method may include forming a shear pad and positioning the same so as to extend outwardly away from said tank from a position adjacent a lower portion of the outer face of said wall and so as to provide a space between the shear pad and the tank. Ideally, and in further accordance with the invention, the tank wall may be cylindrical, the floor slab may be formed monolithically and the shear pad and said floor slab may be generally coplanar.

In accordance with this latter aspect of the invention, an elongated flexible connecting element may be supplied and arranged so as to extend through the space in interconnecting relationship relative to the shear pad and the tank. Desirably the tank structure may be constructed in such a way that a resilient elastomeric material is disposed in the space with the flexible connecting element extending through said elastomeric material. Ideally there may be a plurality of flexible connecting elements and the same may comprise steel cables and may be provided with a corrosion resistant coating.

In further accordance with the invention, the method for construction of a storage tank structure which is resistant to sliding may include constructing the tank and the shear pad of concrete and embedding one end of the flexible connecting element in the shear pad and embedding an opposite end thereof in said tank.

DETAILED DESCRIPTION OF THE PREFERRED EMBODIMENTS

Figure 1:
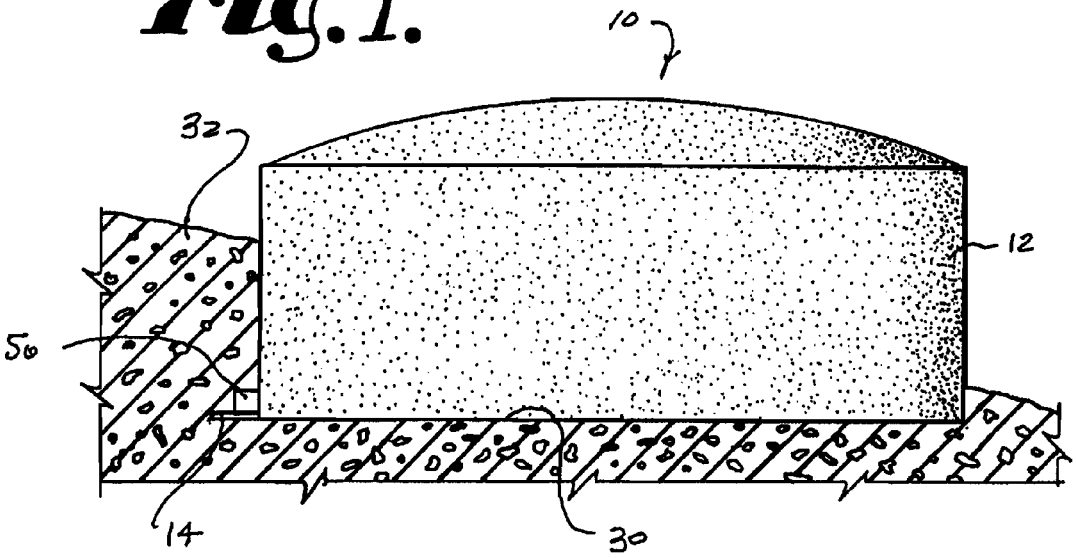
FIG. 1 is an elevational view, partly in cross-section, schematically showing a tank structure constructed in accordance with the invention that is subjected to differential backfilling.
Figure 2:
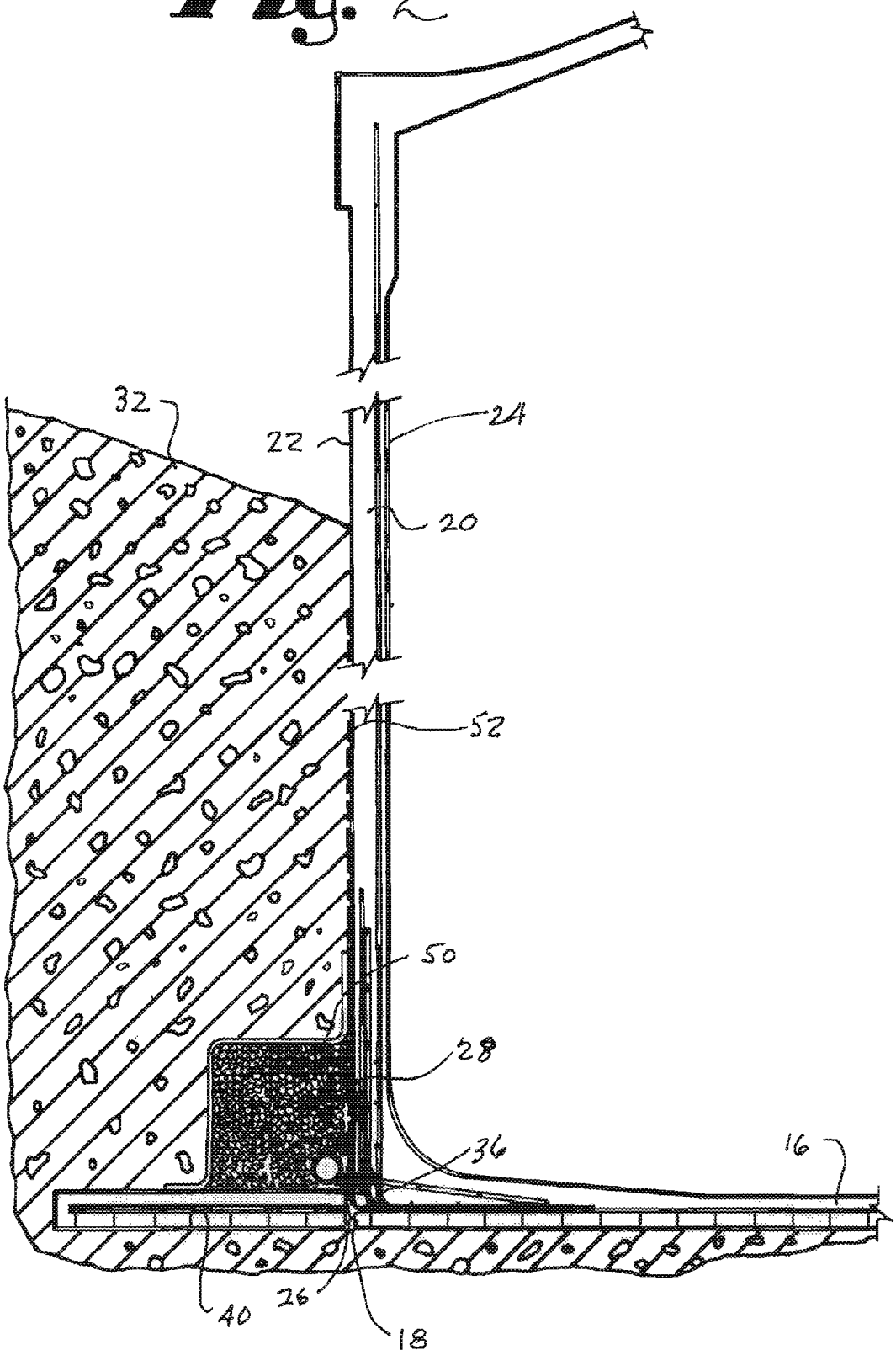
FIG. 2 is an enlarged cross-sectional view showing a backfilled, uphill wall of the tank of FIG. 1.

A storage tank structure 10 that embodies the concepts and principles of the invention is illustrated in FIG. 1 where it can be seen that the same includes a storage tank 12 and a shear pad 14. As can be seen in FIG. 1, tank structure 10 is constructed on a hillside site where the terrain slopes downwardly from left to right. As can be seen viewing FIG. 2, tank 12 includes a floor slab 16 having a periphery 18 and a wall 20 that extends upwardly from a position on floor slab 16 adjacent periphery 18. Wall 20 has an outer face 22 and an inner face 24.

Desirably, in accordance with one preferred embodiment of the invention, tank 12 may be of a conventional design of the sort illustrated in U.S. Pat. No. 5,150,551 (the "'551 patent"). That is to say, tank 12 may be a prestressed composite concrete tank. Such tanks are also illustrated broadly in U.S. Pat. No. 2,370,780 (the "'780 patent") and in U.S. Pat. No. 3,822,520 (the "'520 patent"). The entireties of the disclosures of the '551 patent, the '780 patent and the '520 patent are incorporated herein by this specific reference thereto.

As shown, shear pad 14 may be positioned on the uphill side of tank 12, and the same may extend outwardly away from a position 26 adjacent a lower portion 28 of outer face 22 of tank 12. As discussed above, and again with reference to FIG. 1, tank structure 10 is generally to be constructed on the side of a hill. Accordingly, prior to construction of tank structure 10, the earth is excavated to provide a level base 30 for structure 10. Then, after construction, the excavated terrain is reestablished, particularly on the uphill side of the tank 12, using backfill 32, to restore natural grades and to prevent erosion around tank structure 10. As can be seen, backfill 32 places a substantial downwardly directed burden on shear pad 14.

Figure 3:
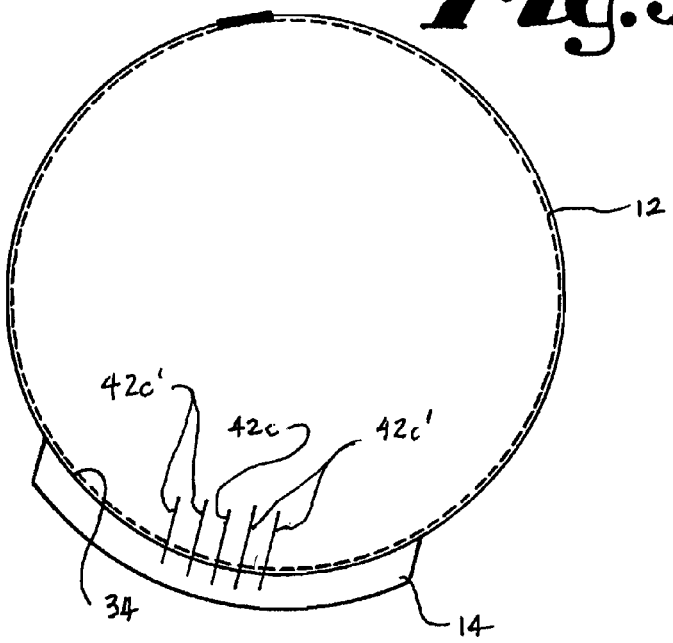
FIG. 3 is a top plan view of the tank.
Figure 4:
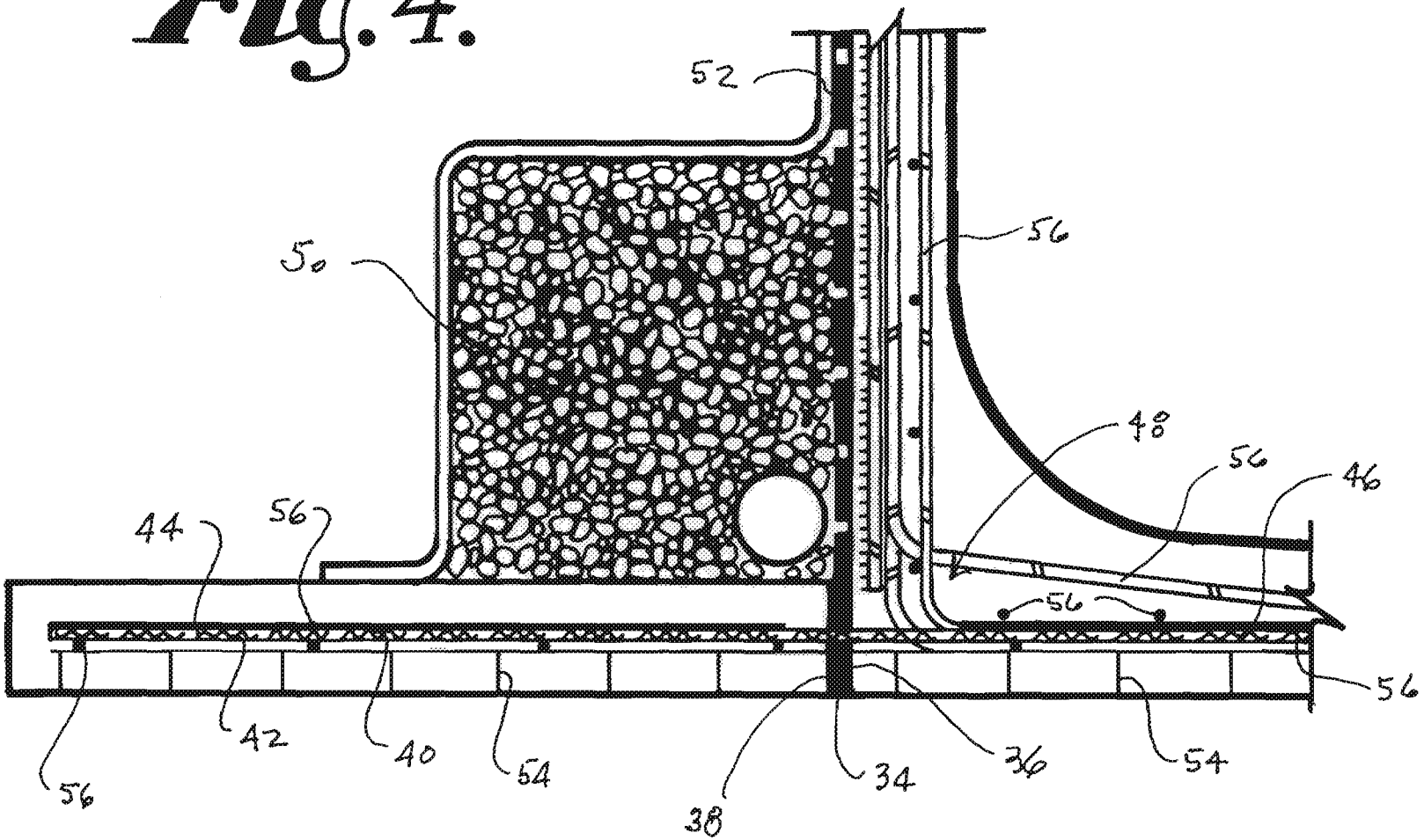
FIG. 4 is an enlarged view showing the lower portion of the wall of FIG. 2.

With reference to FIG. 4, it can been that shear pad 14 and floor slab 16 are generally and preferably co-planar. In this regard it is to be noted that shear pad 14 may generally and preferably also be constructed of poured concrete, and the same may be constructed after floor slab 16 and wall 20 of tank 12 have been poured. As shown in FIG. 3, shear pad 14 may generally be constructed in the form of an arc which extends at least partially around the periphery of tank 12. In this regard, the exact shape of shear pad 14 depends somewhat upon the shape and depth of the overlying terrain, with the principal consideration being to provide an appropriate amount of added frictional surface area between pad 14 and the underlying level ground surface 30. The calculation of the desirable amount of surface area should be well within the ordinary skill of the routineer in the outdoor storage tank construction art.

Preferably, the inner arcuate surface 34 of shear pad 14 may be located in spaced relationship relative to outer face 22 of tank 12 so as to present a circumferentially extending arcuate space 36 therebetween. Desirably, a circumferentially elongated strip 38 of a resilient elastomeric material, which ideally may comprise neoprene, may be arranged in space 36. In this latter regard, strip 38 and space 36 may preferably be co-extensive in circumferential length such that the entire extent of space 36 is filled with the resilient elastomeric material. Desirably space 36 may have a width (between tank 12 and pad 14) of from 1 to 1.5 inches, and ideally the width may be 1 inch. Whatever the case, the width of the space 36 simply needs to be sufficient to minimize the possibility of physical contact between the tank 12 and the pad 14 that might otherwise interfere with the ability of the latter to flex relative to the tank 12. Preferably the width of strip 38 should be essentially the same as the width of space 36. In this latter regard, the principle purpose of strip 38 is to fill space 36 and flex sufficiently during use so as to remain in place in space 36.

In further accordance with the invention, tank structure 10 may preferably include a plurality of elongated flexible connecting elements 40, which desirably may be comprised of steel cables 42. A preferred arrangement of the cables 42 is illustrated schematically in FIG. 3 where it can be seen that a centrally located steel cable 42*c* is preferably located at the centerline of the pad 14 and positioned so as to extend in a direction radially of tank 12. The remaining cables 42*c*' may desirably be arranged in spaced apart relationship and in parallelism with cable 42*c* as shown.

As shown in FIG. 4, ends 44 of cables 42 may desirably be embedded in shear pad 14 and the opposite ends 46 of cables 42 may be embedded in floor slab 16. Moreover, as can also be seen in FIG. 4, cables 42 may ideally be arranged to extend through space 36 and thus through strip 38. Ideally, cables 42 may be provided with a corrosion resistant coating of the sort well known to those of ordinary skill in the tank construction art. Although only five cables 42 are shown in FIG. 3, it is to be understood that in a practical sense a sufficient number of cables 42 will be required to prevent substantial separation of pad 14 from tank 12 and yet provide a degree of flexibility to the overall structure sufficient to minimize the transfer of moments between wall 20 and floor slab 16. Such cables 42 will desirably be distributed in an array which is parallel to cable 42*c* and therefore to the centerline of pad 14.

As can be seen from FIG. 4, tank 12 may desirably include a monolithic joint 48 between floor slab 16 and wall 20. In this regard shear pad 14 of the invention is particularly adapted for use in connection with tanks having monolithic joints. On the other hand, there may be occasions where shear pad 14 of the invention is appropriate for use in connection with tanks which include a joint between the wall and the floor which is not monolithic.

As is known to those of ordinary skill in the storage tank field, the tank structure 10 may include a conventional French drain 50 and a conventional geocomposite drain 52 wrapped around the exterior thereof. Also, the tank 12 and the shear pad 14 may each include conventional reinforcing steel in the nature of wire bar supports 54 and bars 56.

In a useful embodiment of the tank structure 10 of the invention, the tank 12 may be circular and have an inside diameter of approximately 50 feet, 6 inches. The height of wall 20 may simply be sufficient to accommodate the design capacity of the tank 12 for holding a liquid. With such a tank structure, the shear pad 14 may have a vertical dimension of about 5 inches, a radial (relative to the tank 12) dimension of about 2 feet, and a circumferential extension around the base of the tank 12 of about 90 degrees. The orientation of the shear pad 14 should ideally be such that the center point of the same is disposed beneath the high point of the backfill.

For the preferred embodiment described above, the cables 42 may be 0.5 inches in diameter and approximately 6 feet 6 inches long. Desirably the cables 42 may be 270 KSI 7-wire strand epoxy coated Flo-Bond restraint cables and the same may be spaced apart at intervals of about 5 inches. The cables 42 may be arranged such that the portions thereof that are embedded in the shear pad 14 may extend to within about 2 inches of the outer edge of the pad. Moreover, the strip 38 may ideally be 1 inch thick by 5 inches wide, and the same may desirably be formed from R-423-N Neoprene.

The invention also includes a method for construction of a storage tank structure 10 with sliding resistance. Such method includes erecting a tank 12 including a floor slab 16 having a periphery 18 and a wall 20 having inner and outer faces 24, 22 extending upwardly from floor slab 16 at a position thereon adjacent periphery 18. Contemporaneously, a shear pad 14 is formed in a position to extend outwardly away from tank 12 from a position 26 adjacent a lower portion 28 of outer face 22 of wall 20. The pad 14 is positioned so as to provide a space 36 between the shear pad 14 and the tank 12. A plurality of elongated flexible connecting elements 40 are supplied and arranged so as to extend through space 36 in interconnecting relationship relative to shear pad 14 and tank 12.

I claim:

1. A storage tank structure that is resistant to sliding or damage when subjected to external forces imposed thereon as a result of backfilling or movement of adjacent earth comprising:

a storage tank including (1) a floor slab lying on a ground surface and having a periphery, and (2) a wall extending upwardly from a position on said floor slab adjacent said periphery, said wall having an outer face;

a shear pad extending outwardly away from said tank from a position adjacent a lower portion of said outer face, said shear pad and said tank being positioned relative to one another in such a way that a space is provided therebetween, a plurality of elongated flexible connecting elements extending through said space in a direction outwardly away from said outer face, said elements being disposed in interconnecting relationship relative to the shear pad and the tank, said space being disposed outwardly of said periphery in a position to provide room for flexing of the shear pad relative to the tank when said external forces are imposed on the tank.

2. A storage tank structure as set forth in claim 1, wherein said wall and said floor slab are monolithic.

3. A storage tank structure as set forth in claim 1 or claim 2, wherein said shear pad and said floor slab are generally coplanar.

4. A storage tank structure as set forth in claim 1, wherein said tank structure includes a resilient elastomeric material disposed in said space, and wherein said flexible connecting elements extend through said elastomeric material.

5. A storage tank structure as set forth in claim 1, wherein said flexible connecting elements comprise steel cables.

6. A storage tank structure as set forth in claim 1, wherein said flexible connecting elements are provided with a corrosion resistant coating.

7. A storage tank structure as set forth in claim 5, wherein said flexible connecting elements are provided with a corrosion resistant coating.

8. A storage tank structure as set forth in claim 1, wherein said tank and said shear pad are each constructed of concrete and wherein a plurality of said flexible connecting have one end embedded in said shear pad and an opposite end embedded in said tank.

9. A storage tank structure as set forth in claim 3, wherein said tank and said shear pad are each constructed of concrete and wherein a plurality of said flexible connecting have one end embedded in said shear pad and an opposite end embedded in said tank.

10. A storage tank structure as set forth in claim 9, wherein said flexible connecting elements comprise steel cables.

11. A storage tank structure as set forth in claim 10, wherein said flexible connecting elements are provided with a corrosion resistant coating.

12. A storage tank structure as set forth in claim 11, wherein said tank structure includes a resilient elastomeric material disposed in said space, and wherein said flexible connecting elements extend through said elastomeric material.

13. A storage tank structure as set forth in claim 1 or claim 2, wherein said wall is generally cylindrical.

14. A method for construction of a storage tank structure that is resistant to sliding or damage when subjected to external forces imposed thereon as a result of backfilling or movement of adjacent earth comprising:

erecting a storage tank including a floor slab having a periphery and a wall extending upwardly from said floor slab at a position on the floor slab adjacent said periphery, said wall having an outer face, said floor slab lying on a ground surface;

forming a shear pad and positioning the same so as to extend outwardly away from said tank from a position adjacent a lower portion of said outer face and so as to provide a space between the shear pad and the tank; and supplying an elongated flexible connecting element and arranging the same (1) so as to extend through said space in a direction outwardly away from said outer face and (2) in interconnecting relationship relative to the shear pad and the tank, said space being disposed outwardly of said periphery in a position to provide room for flexing of the shear pad relative to the tank when said external forces are imposed on the tank.

15. A method for construction of a storage tank structure that is resistant to sliding or damage as set forth in claim 14, wherein said wall and said floor slab are formed monolithically.

16. A method for construction of a storage tank structure that is resistant to sliding or damage as set forth in claim 14 or claim 15, wherein said shear pad and said floor slab are generally coplanar.

17. A method for construction of a storage tank structure that is resistant to sliding or damage as set forth in claim 14, wherein said tank structure includes a resilient elastomeric material disposed in said space, and wherein said flexible connecting elements extend through said elastomeric material.

18. A method for construction of a storage tank structure that is resistant to sliding or damage as set forth in claim 14, wherein said flexible connecting elements comprise steel cables.

19. A method for construction of a storage tank structure that is resistant to sliding or damage as set forth in claim 14, wherein said flexible connecting elements are provided with a corrosion resistant coating.

20. A method for construction of a storage tank structure that is resistant to sliding or damage as set forth in claim 18, wherein said flexible connecting elements are provided with a corrosion resistant coating.

21. A method for construction of a storage tank structure with that is resistant to sliding or damage as set forth in claim 14, wherein said tank and said shear pad are each constructed of concrete and wherein said flexible connecting element has one end embedded in said shear pad and an opposite end embedded in said tank.

22. A method for construction of a storage tank structure that is resistant to sliding or damage as set forth in claim 16, wherein said tank and said shear pad are each constructed of concrete and wherein said flexible connecting element has one end embedded in said shear pad and an opposite end embedded in said floor slab.

23. A method for construction of a storage tank structure that is resistant to sliding or damage as set forth in claim 21, wherein said flexible connecting elements comprise steel cables.

24. A method for construction of a storage tank structure that is resistant to sliding or damage as set forth in claim 23, wherein said flexible connecting elements are provided with a corrosion resistant coating.

25. A method for construction of a storage tank structure that is resistant to sliding or damage as set forth in claim 24, wherein said tank structure includes a resilient elastomeric material disposed in said space, said flexible connecting elements extending through said elastomeric material.

26. A method for construction of a storage tank structure that is resistant to sliding or damage as set forth in claim 14 or claim 15, wherein said wall is generally cylindrical.

27. A storage tank structure that is resistant to sliding or damage when subjected to external forces imposed thereon as a result of backfilling or movement of adjacent earth comprising:

a tank including (1) a floor slab lying on a ground surface and having a periphery, and (2) a wall extending upwardly from a position on said floor slab adjacent said periphery, said wall having an outer face; and a shear pad extending in a direction outwardly away from said tank from a position adjacent a lower portion of said outer face, wherein said shear pad and said tank being positioned relative to one another in such a way that a space is provided therebetween, said shear pad being flexibly attached to said tank by elongated flexible structure extending through said space between the tank and the shear pad in said direction, said elongated flexible structure being arranged to facilitate independent movement of the shear pad relative to the tank during shifting of the tank and such that any forces imposed on the wall of the tank are minimized when the tank is subjected to said external forces, and said space being disposed outwardly of said periphery in a position to provide room for flexing of the shear pad relative to the tank when said external forces are imposed on the tank.

* * * * *